US008201516B2

(12) United States Patent
Daniels

(10) Patent No.: US 8,201,516 B2
(45) Date of Patent: Jun. 19, 2012

(54) REMOVABLE BOAT WINDSHIELD AND METHOD FOR INSTALLING/REMOVING THE SAME

(75) Inventor: Brian K. Daniels, Bradenton, FL (US)

(73) Assignee: Taylor Made Group, LLC, Gloversville, NY (US)

( * ) Notice: Subject to any disclaimer, the term of this patent is extended or adjusted under 35 U.S.C. 154(b) by 326 days.

(21) Appl. No.: 12/569,403

(22) Filed: Sep. 29, 2009

(65) Prior Publication Data

US 2010/0139546 A1 Jun. 10, 2010

Related U.S. Application Data

(60) Provisional application No. 61/102,738, filed on Oct. 3, 2008.

(51) Int. Cl.
*B63B 17/00* (2006.01)

(52) U.S. Cl. ..... 114/361

(58) Field of Classification Search ..... 114/361; 403/79, 92, 154, 76, 90
See application file for complete search history.

(56) References Cited

U.S. PATENT DOCUMENTS

| | | | | |
|---|---|---|---|---|
| 3,829,153 | A * | 8/1974 | Fussell et al. | 296/90 |
| 4,941,481 | A * | 7/1990 | Wagenknecht | 606/59 |
| 5,297,445 | A * | 3/1994 | Chen | 74/551.3 |
| 7,162,968 | B2 * | 1/2007 | Thompson | 114/361 |
| 7,845,304 | B2 * | 12/2010 | Daniels et al. | 114/361 |

* cited by examiner

*Primary Examiner* — Stephen Avila
(74) *Attorney, Agent, or Firm* — Nixon & Vanderhye P.C.

(57) ABSTRACT

A removable boat windshield is provided that includes a transparent pane with a top end and a bottom end. At least one male portion is attached to the pane. At least one female portion is attachable to a deck of a boat. The at least one female portion defines a receiving opening for receiving at least a portion of the at least one male portion therein. The removable boat windshield also includes a securement device, operable with the at least one female portion, to releasably connect the male portion to the female portion.

15 Claims, 14 Drawing Sheets

REMOVABLE BOAT WINDSHIELD AND METHOD FOR INSTALLING/REMOVING THE SAME

CROSS-REFERENCE TO RELATED APPLICATIONS

This is a U.S. Non-Provisional Patent Application that relies for priority on U.S. Provisional Patent Application Ser. No. 61/102,738, filed on Oct. 3, 2008, the contents of which are incorporated herein by reference.

FIELD OF THE INVENTION

The invention relates to a windshield for a boat. In particular, the invention relates to a windshield for a boat where the windshield may be replaceably removed from the deck of a watercraft, such as a boat. The invention also relates to a method for installing and removing a removable boat windshield.

DESCRIPTION OF THE RELATED ART

In the boating industry, it is common for a windshield to be mounted on the deck of a boat (or other suitable type of watercraft) such that it cannot be removed easily, if at all, without damaging the deck of the boat.

As should be appreciated by those skilled in the art, it is common for boat owners to store boats seasonally, depending upon the extremes of weather experienced in a particular geographic region. Specifically, in more northern areas, it is quite common for boat owners to remove their boats from the water and have them stored in an appropriate marina storage facility during winter months.

In many cases, the windshields of boats are susceptible to damage during the process storing the boat in the appropriate marina facility. Accordingly, it is desirable to have a windshield that may be replaceably removed from the deck of the boat to reduce the occurrence of windshield damage.

Moreover, marina facilities often store boats in a stacked manner. Since the windshield adds to the overall height of a boat, a stack of taller boats requires a taller storage facility. Naturally, this adds to the cost of the storage facility and also adds to the individual cost of storage of the boat.

Naturally, to reduce storage costs, boat owners and marina facilities would like to store as many boats in as small a facility as is reasonable. One way to increase storage space is to reduce the height of the boat by, for example, removing the windshield.

Typically, the windshields are installed at the factory to make sure they fit properly. If the windshield may be easily removed for shipping and reinstalled after delivery, the cost of shipping may be reduced. The stacking height is also a factor in reducing transportation cost. By removing the windshield, more boats may be shipped on a single flat bed truck or train.

As should be appreciated by those skilled in the art, windshields on boats are typically affixed to the deck via threaded fasteners, adhesives, or a combination of the two. Accordingly, removal of the windshield is not a simple matter.

In addition, if a traditional windshield were removed and replaced in a repetitive manner, it is conceivable that the threaded holes in the deck could degrade after repeated removal and replacement of the windshield, thereby rendering the reattachment of the windshield to the deck a near impossibility (without, of course, drilling new holes in the deck).

Separate from the storage concerns, there is a growing portion of the boating community that would like to have the ability to remove a windshield from a boat before or during normal operation. For some boaters, a windshield is an inconvenience that they would like to eliminate, at their discretion.

These needs in the prior art remain unaddressed.

SUMMARY OF THE INVENTION

It is, therefore, one aspect of the invention to provide a windshield that may be removably affixed to the deck of a boat.

In this regard, the invention provides for a removable boat windshield that includes a transparent pane with a top end and a bottom end. At least one male portion is attached to the pane. At least one female portion attachable to a deck of a boat. The at least one female portion defines a receiving opening for receiving at least a portion of the at least one male portion therein. A securement device releasably connects the male portion to the female portion. The securement device is associated with the at least one female portion.

With respect to another embodiment of the securement device, the invention provides that the at least one female portion comprises a bracket block that defines the receiving opening. The receiving opening is disposed in a longitudinal direction in the bracket block. The at least one female portion defines a hole extending through the bracket block transversely to the receiving opening. The securement device includes a pin that is removably disposable within the hole. When the pin is disposed within the hole, the pin prevents the at least one male portion from being removed from the receiving opening.

In still another embodiment of the invention, the at least one male portion includes a bracket securable to the pane and a protrusion attached to the bracket, extending a predetermined distance from the pane. At least a portion of the protrusion is received in the receiving opening of the at least one female portion.

With respect to one further embodiment of the invention, the at least one male portion includes a shaped end disposed at an end of the protrusion opposite to the bracket. The shaped end may be spherical.

Another embodiment of the invention provides for the bracket and protrusion of the at least one male portion to be integrally formed.

Other aspects of the invention will be made apparent to those skilled in the art from the description that follows and from the drawings appended hereto.

BRIEF DESCRIPTION OF THE DRAWINGS

The invention will now be described in connection with the drawings appended hereto, where like reference numerals refer to like structures, features, and elements, in which.

DESCRIPTION OF EMBODIMENT(S) OF THE INVENTION

While the invention is described in connection with various embodiments, it should be understood that the invention is not limited solely to the embodiments described herein. As should be apparent to those skilled in the art, there are numerous variations and equivalents of the embodiments that may be employed without departing from the scope of the invention.

Figure 1:
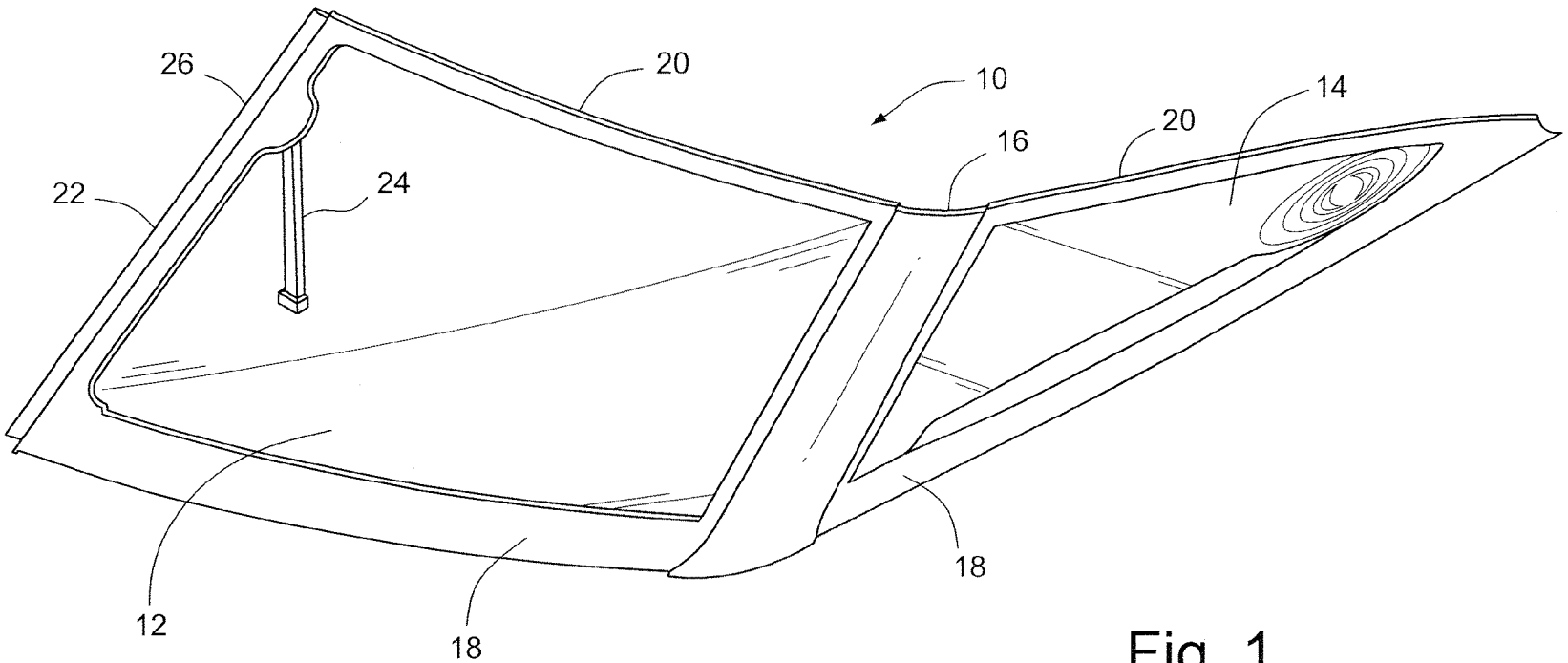
FIG. 1 is a perspective illustration of a port-side windshield segment, constructed in accordance with one embodiment of the invention.

FIG. 1 is a perspective illustration of a port side windshield segment 10. The port side windshield segment 10 includes a front windshield segment 12 and a side windshield segment 14 that are connected to one another via a corner bracket 16. The corner bracket 16 is expected to be a rigid element. However, it is also contemplated that the corner bracket 16 may be flexible or semi-flexible.

The windshield segment 10 also may include a bottom frame 18 and a top frame 20. In addition, for the starboard edge of the front windshield segment 12, a side frame element 22 may be provided. As should also be appreciated by those skilled in the art, one or more of the frame elements 18, 20, 22 may be excluded from the windshield segment 10 without departing from the scope of the invention. Also visible in FIG. 1 is a stanchion 24 that supports the starboard edge 26 of the windshield segment 10 by connecting to the deck of the watercraft.

The corner bracket 16, the bottom frame 18, the top frame 20, the side frame element, and the stanchion 24 are all contemplated to be made from a corrosion-resistant material. The corrosion-resistant material is contemplated to be aluminum or an alloy thereof. However, other materials may be employed, such as stainless steel, plastics, composite materials, wood, ceramics, etc. The invention is not intended to be limited by the material selected. It is contemplated, however, that a light-weight material will be employed, where feasible. A light-weight material is expected to facilitate installation and removal of the windshield segment 10 from the deck of a boat or other type of watercraft.

Figure 2:
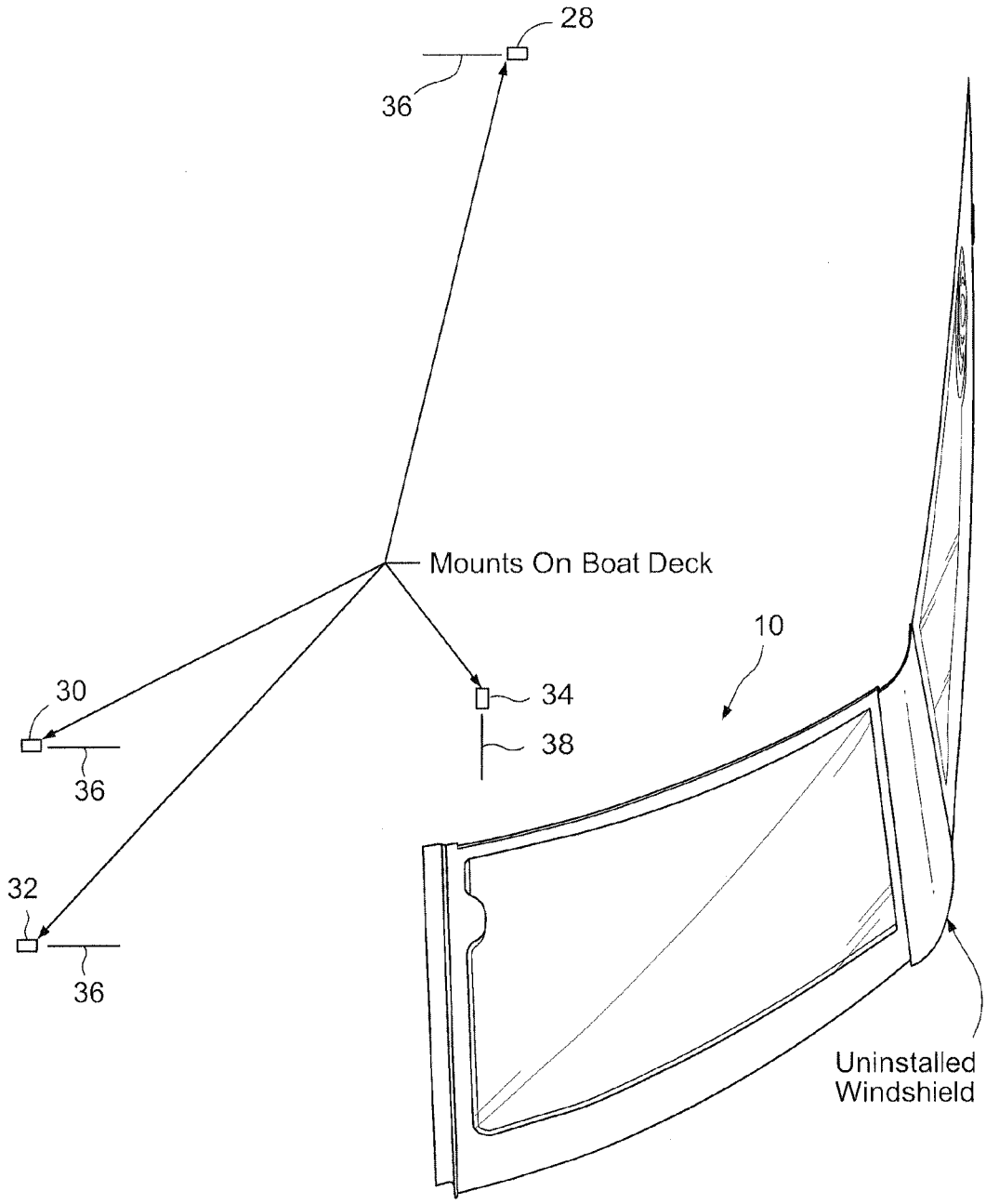
FIG. 2 is a top plan view of the port side windshield segment illustrated in FIG. 1, also including a schematic illustration of mounts for the port side window segment.

FIG. 2 provides a top view of the windshield segment 10 illustrated in FIG. 1. This top view shows the approximate locations of several female portions 28 of the securement devices that are part of the invention. The construction of the female portions is discussed in greater detail below.

With reference to FIG. 2, four (4) female portions or brackets 28, 30, 32, 34 are illustrated. These four brackets 28, 30, 32, 34 are located such that, when the windshield segment 10 is secured thereto, it is contemplated that the brackets 28, 30, 32, 34 will hold the windshield segment 10 in a stable condition when the boat is stationary or is in motion. As should be appreciated by those skilled in the art, a greater number or a fewer number of brackets 28, 30, 32, 34 may be employed without departing from the scope of the invention.

As is apparent, three of the brackets 28, 30, 32 are oriented in a lateral orientation 36 and one is oriented in a longitudinal orientation 38. For purposes of this discussion, a lateral orientation 36 is intended to refer to an orientation extending between the lateral sides (or port and starboard sides) of a boat. The longitudinal orientation 38 is intended to refer to an orientation extending between the front and rear (or bow and stern) of a boat. As should be appreciated by those skilled in the art, these orientations 36, 38 are not intended to be the only orientations for the brackets 28, 30, 32, 34. To the contrary, the brackets 28, 30, 32, 34 may be positioned at any suitable angle with respect to the lateral orientation 36 or to the longitudinal orientation 38.

Figure 3:
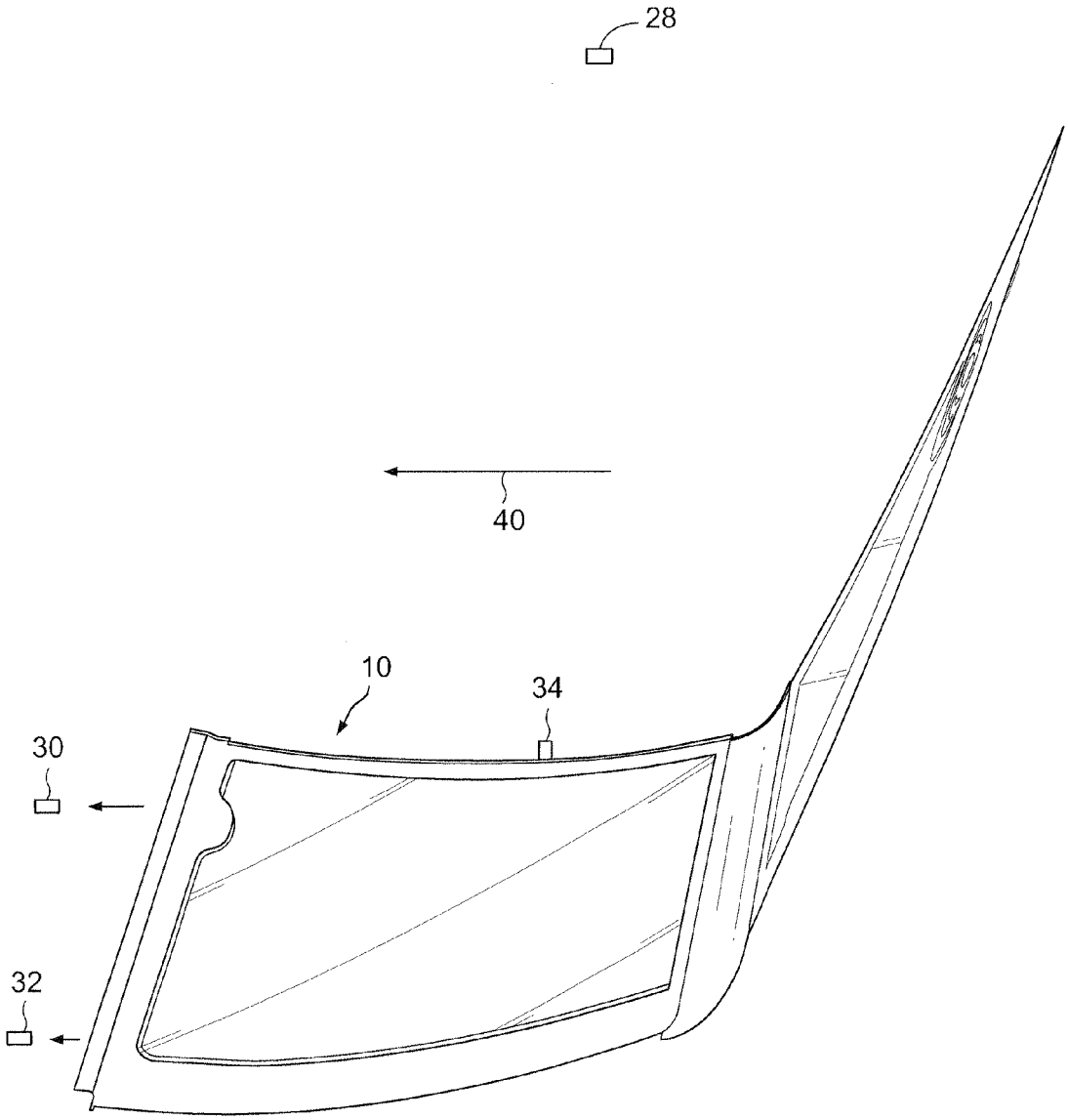
FIG. 3 is a top plan view of the port side windshield segment illustrated in FIGS. 1 and 2, illustrating a portion of the installation of the windshield onto the deck of a watercraft.

FIG. 3 illustrates a first operation for installation of the window segment 10 onto the deck of a boat. Specifically, after the brackets 28, 30, 32, 34 are secured to the deck of a boat, the window segment 10 is first shifted in a starboard direction 40 to engage the brackets 30, 32. As will be clarified below, the male portions affixed to the windshield segment 10 are moved into engagement with the complimentary female portions or brackets 30, 32.

In connection with this figure, and as detailed below, it is noted that the brackets 28, 30, 32, 34 may be provided with an adhesive backing to facilitate placement of the brackets 28, 30, 32, 34 on the surface of a deck. Once the final position of the brackets 28, 30, 32, 34 is determined, the brackets 28, 30, 32, 34 may be secured to the deck in a more permanent fashion such as with fasteners. A commonly-used fastener is one or more screws. It is contemplated that the brackets 28, 30, 32, 34 will affixed to the deck with at least two screws to discourage rotation of the brackets 28, 30, 32, 34 after installation.

It is noted that the present invention does not require that the brackets 28, 30, 32, 34 include an adhesive backing. Other semi-permanent means may be employed to hold the brackets 28, 30, 32, 34 in place before being secured with fasteners. For example, a tacky paste or putty may be employed. Similarly, the brackets 28, 30, 32, 34 may be secured with a silicone caulk or other similar liquid material.

Figure 4:
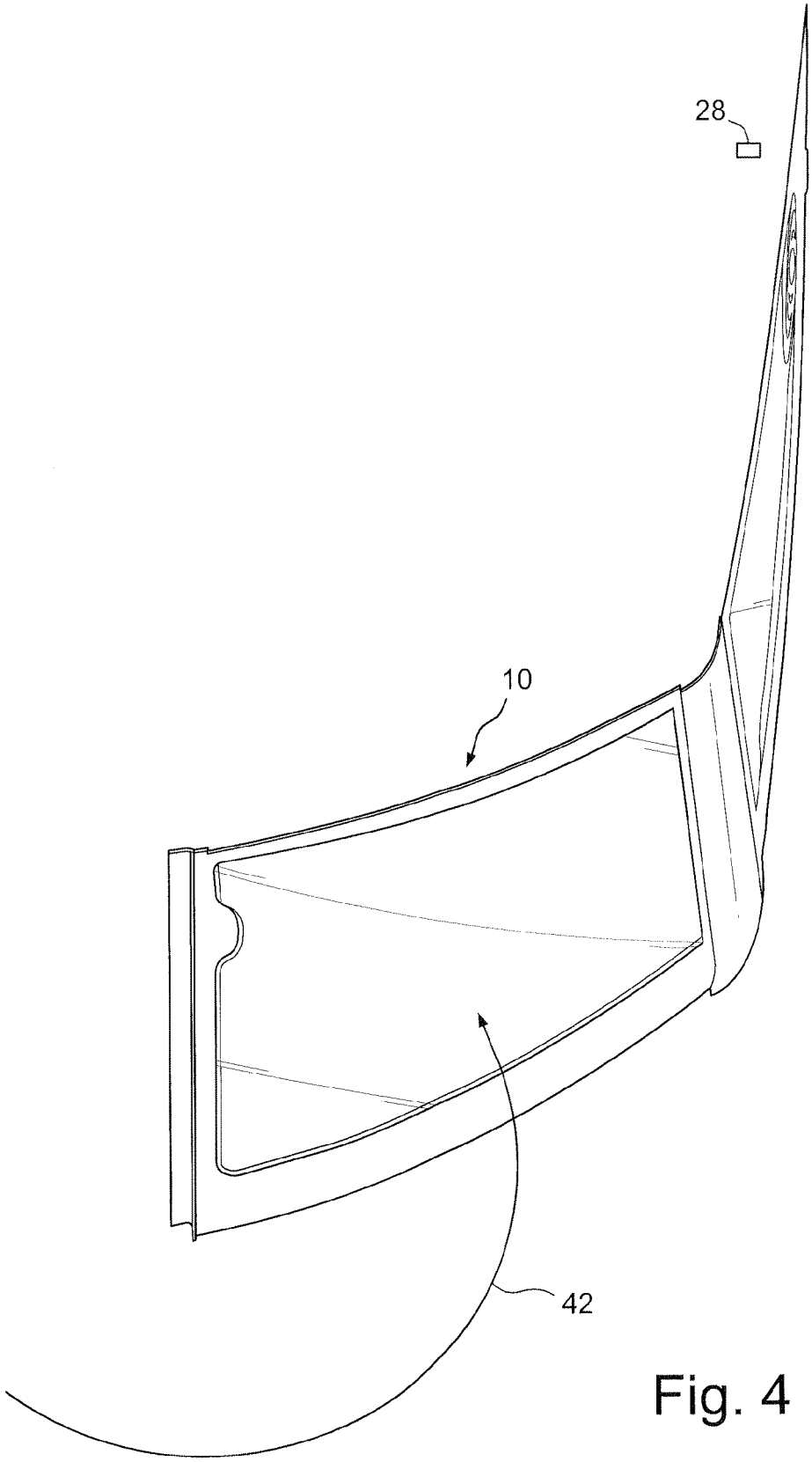
FIG. 4 is a top plan view of the port side windshield segment illustrated in FIG. 1-3, illustrating another portion of the installation of the windshield onto the deck of a watercraft.

FIG. 4 illustrates a second operation for manipulation of the window segment 10. In the second operation, the window segment is rotated in a counterclockwise direction 42. The counterclockwise rotation 42 permits the window segment 10 to engage the bracket 34.

Figure 5:
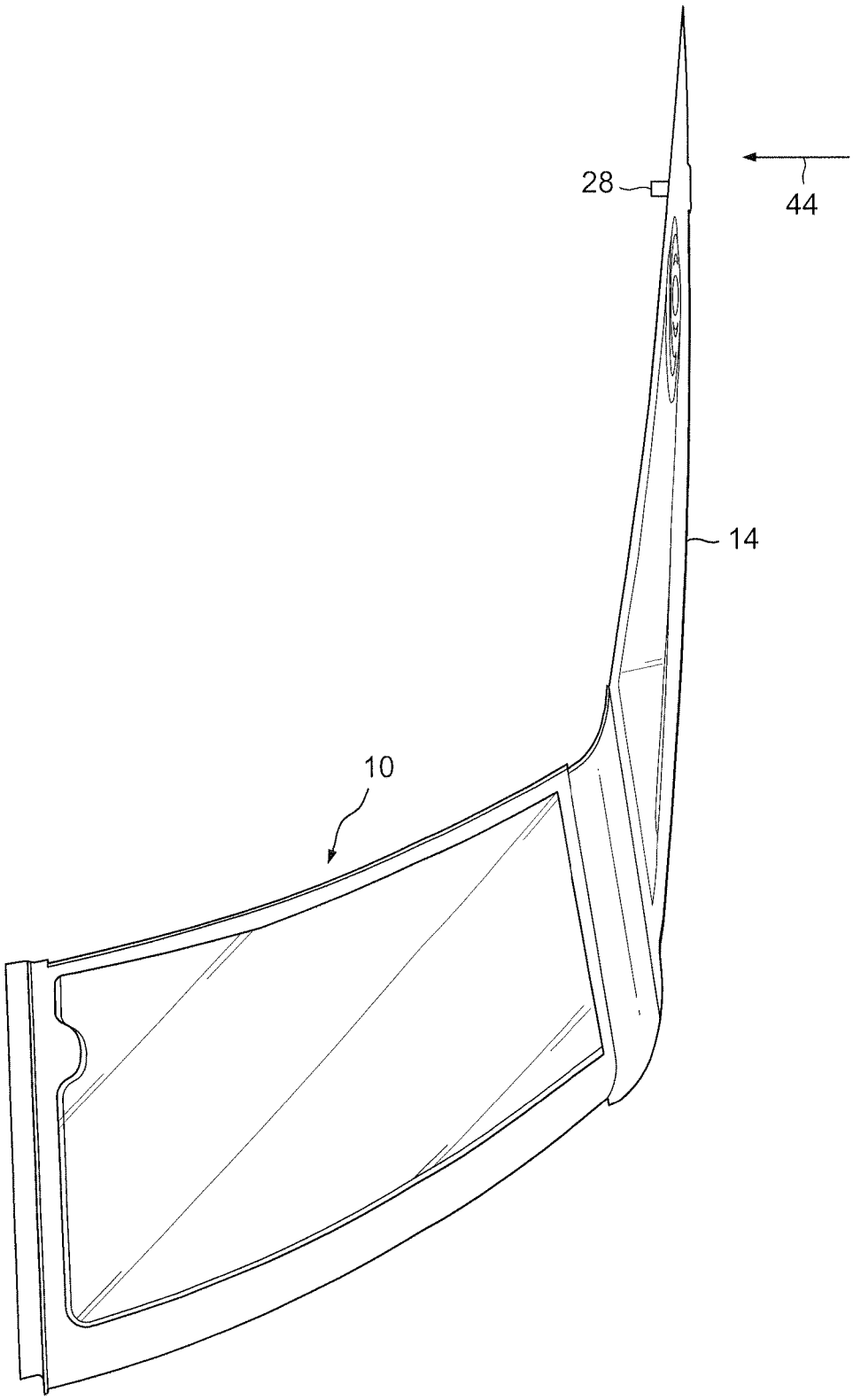
FIG. 5 is a top plan view of the port side windshield segment illustrated in FIG. 1-4, illustrating still another portion of the installation of the windshield onto the deck of a watercraft.

FIG. 5 illustrates a third operation for manipulation of the window segment 10. In this figure, the side windshield segment 14 is moved in a lateral direction 44 to engage the bracket 28.

As should be apparent from FIGS. 3-5, the corner bracket 16 permits some pivotal flexibility between the front windshield segment 12 and the side windshield segment 14. However, flexibility between these two window segments 12, 14 is not required to practice the invention.

Figure 6:
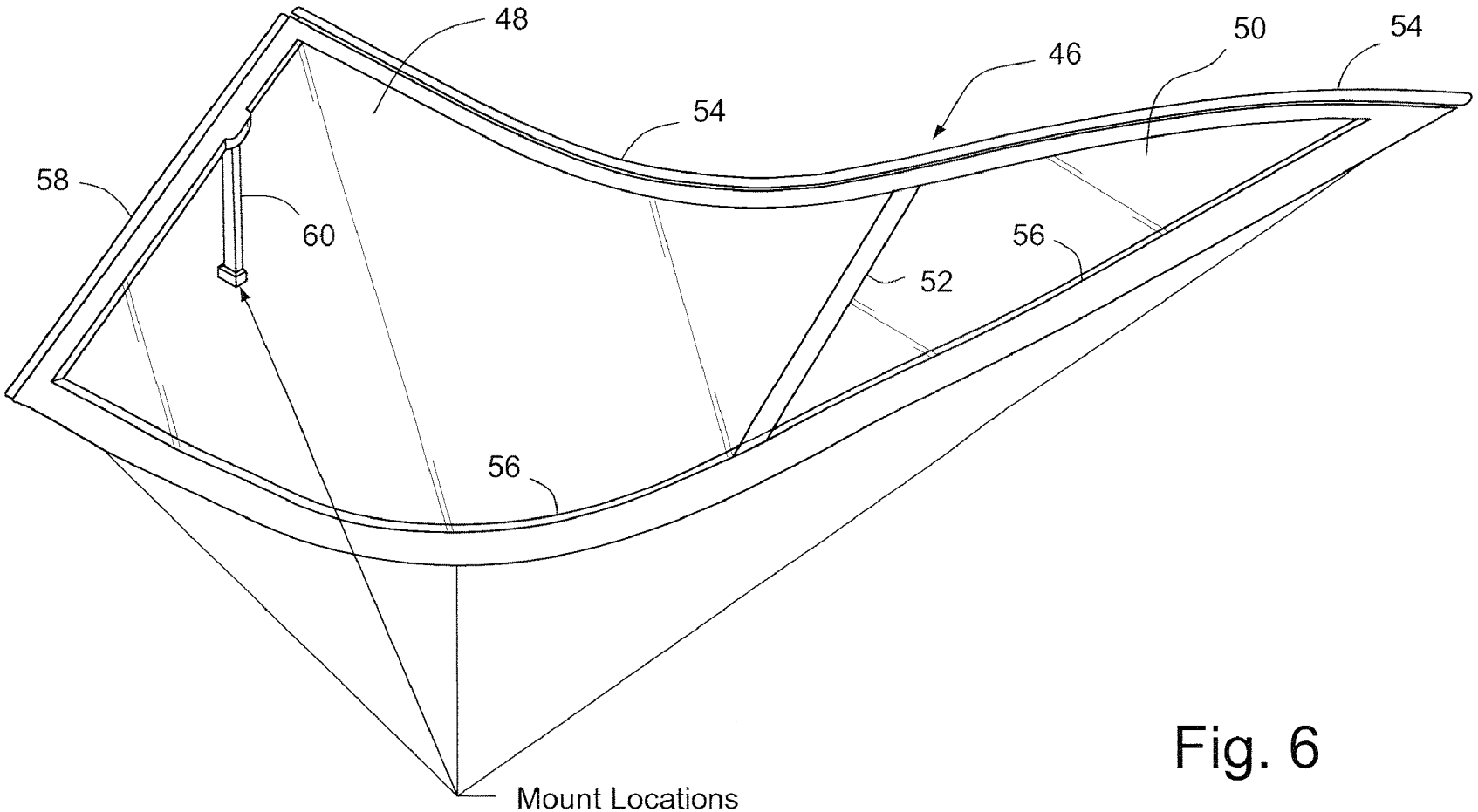
FIG. 6 is a perspective illustration of a second embodiment of a port side windshield segment constructed according to the invention.

FIG. 6 illustrates a second embodiment of a windshield segment 46. This second embodiment also is intended for placement on the port side of a boat. The windshield segment 46 differs from the windshield segment 10 in that a corner bracket 16 is omitted. Instead, the windshield segment 46 includes a curved, front panel 48 and a side panel 50, which are joined to one another via a corner post 52. The corner post 52 extends between a top edge 54 and a bottom edge 56 of the windshield segment 46. The windshield segment 46 also includes a starboard lateral edge 58. As with the windshield segment 10, the windshield segment 46 includes a stanchion 60.

As should be apparent to those skilled in the art, the top edge 54 and the bottom edge 56 sandwich the front and side panels 48, 50 between them. In addition, as should be apparent to those skilled in the art, the windshield segment 46 is more rigid than the windshield segment 10. The exclusion of the corner bracket 16 is one reason for this increased rigidity. Due to the increased rigidity, installation of the windshield segment 46 is expected to differ from the installation of the windshield segment 10. However, it is contemplated that the installation of the windshield segment 46 will be very similar to the installation discussed in connection with FIGS. 3-5. Accordingly, the installation of the windshield segment 46 is not detailed, as it would be largely repetitive of the discussion in connection with FIGS. 3-5, above.

As should also be apparent from the drawings, the windshield segment 46 may be installed using the brackets 28, 30, 32, 34. Due to the increased rigidity of the windshield segment 46 by comparison with the windshield segment 10, it is contemplated that one or more of the brackets 28, 20, 32, 34 may need to be angled with respect to the lateral orientation 36 or the longitudinal orientation 36.

Figure 7:
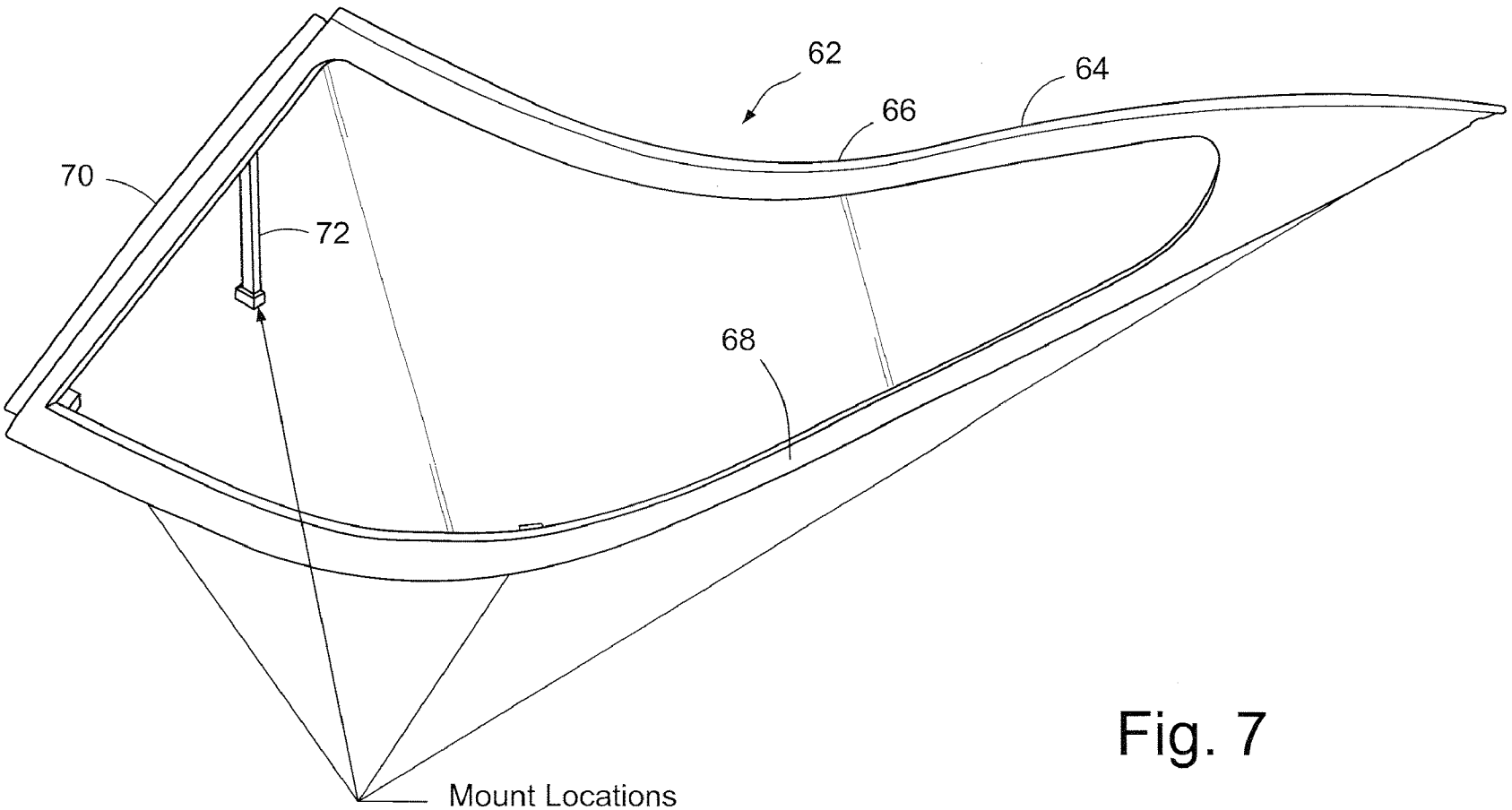
FIG. 7 is a perspective illustration of a third embodiment of a port side windshield segment constructed according to the invention.

FIG. 7 illustrates a third embodiment of a port side windshield segment 62 constructed according to the invention. This embodiment includes a transparent panel 64, a top edge 66, a bottom edge 68, a starboard edge 70, and a stanchion 72. As should be apparent, this embodiment of the windshield segment 62 differs from the prior embodiment 46 in that it excludes the corner post 52. As a result, there is a single curved, transparent pane 64, rather than two. This windshield segment 62 is expected to be even more rigid than the second embodiment 46. Installation, however, is expected to be much the same as discussed above.

As should be apparent to those skilled in the art, removal of the windshield segment 10, 46, 62 is merely a reversal of the installations, discussed above. Accordingly, the removal operations are not detailed herein. As should also be apparent, when the windshield segment 10, 46, 62 is removed, the brackets 28, 30, 32, 34 are intended to remain affixed to the deck.

It is noted that the discussion so far has focused on three embodiments of windshield segments 10, 26, 62 that are adapted for installation on the port side of a boat. The invention is equally applicable to starboard windshield segments (not illustrated). As should be apparent to those skilled in the art, a starboard windshield segment typically is a mirror image of a port side windshield segment. As a result, the construction, installation, and removal of a starboard side window segment parallels the discussion of the windshield segments 10, 46, 62 provided above.

The invention also applies to instances where the windshield does not have port and starboard sections. There are many boat designs where the windshield extends from the port side to the starboard side without any interruptions. In other words, the windshield is a contiguous structure. For these windshield types, the unitary windshield may be installed and removed from the deck of the boat in much the same manner as discussed above.

Figure 8:
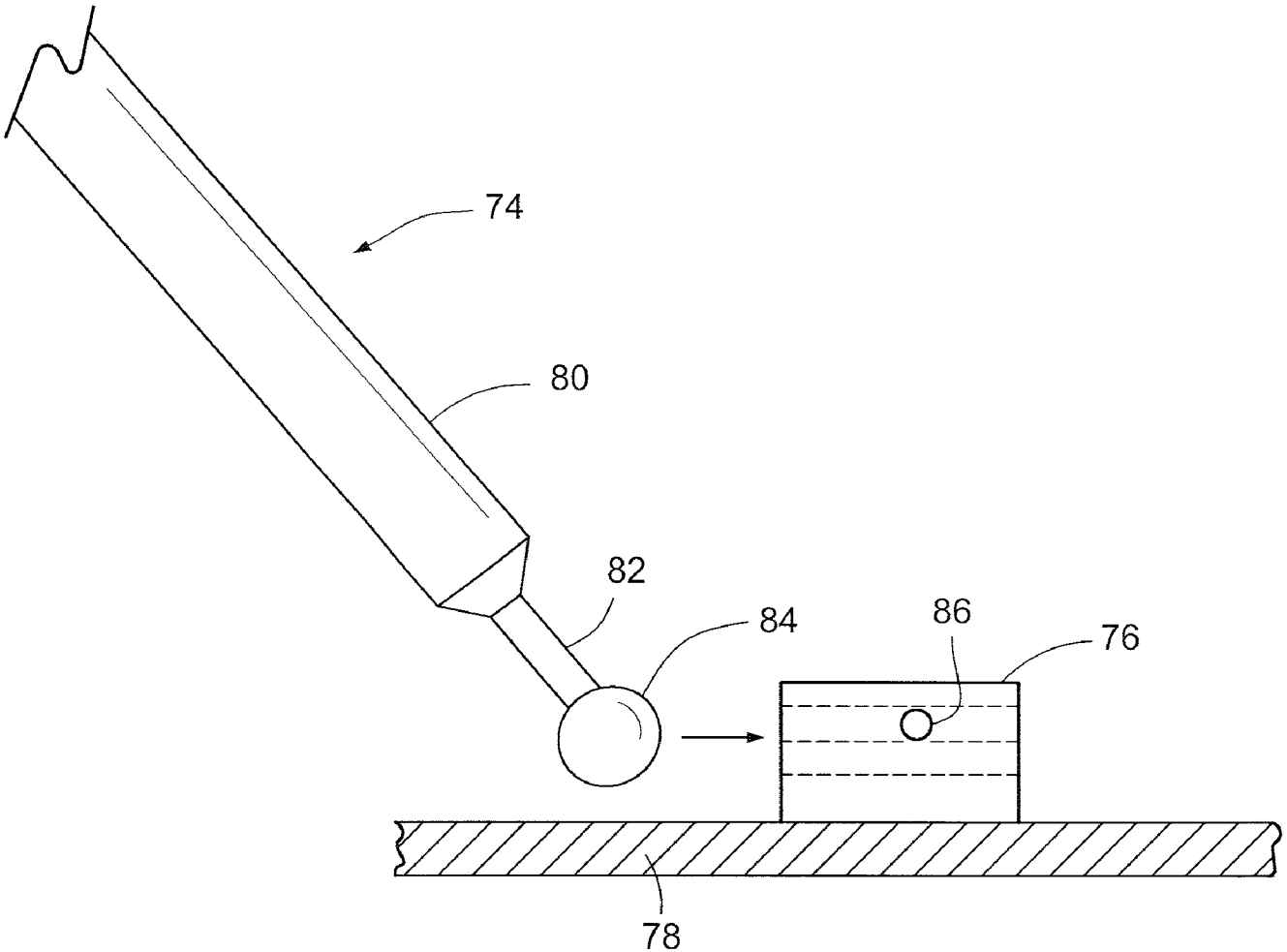
FIG. 8 is a side view illustrating a portion of a stanchion used for supporting a starboard end of the port side windshield segment illustrated in one of the preceding figures.

Reference is now made to FIG. 8, which illustrates one contemplated construction for a part of a stanchion 74. The stanchion 74 may be the same as the stanchions 24, 60, 72 discussed above. Of course, the stanchion 74 may differ therefrom. To emphasize that each of the stanchions 24, 60, 72, 74 are not required to have the same construction, the stanchion 74 is provided with a different reference number. For similar reasons, the bracket or female portion 76 in FIG. 8 is provided with a unique reference number.

The stanchion 74 is intended to engage the female portion or bracket 76 of the securement device. As should be apparent, the bracket 76 is secured to the deck 78 of a boat. The stanchion 74 includes an upper section 80, a necked-down section 82, and a male portion 84 that is inserted into a complimentary receiving opening in the bracket 76. FIG. 8 also illustrates that there is an opening 86 in the bracket 76. The opening 86 is provided so that a pin may be inserted therein to retain the male portion 84 in the bracket 76.

Figure 9:
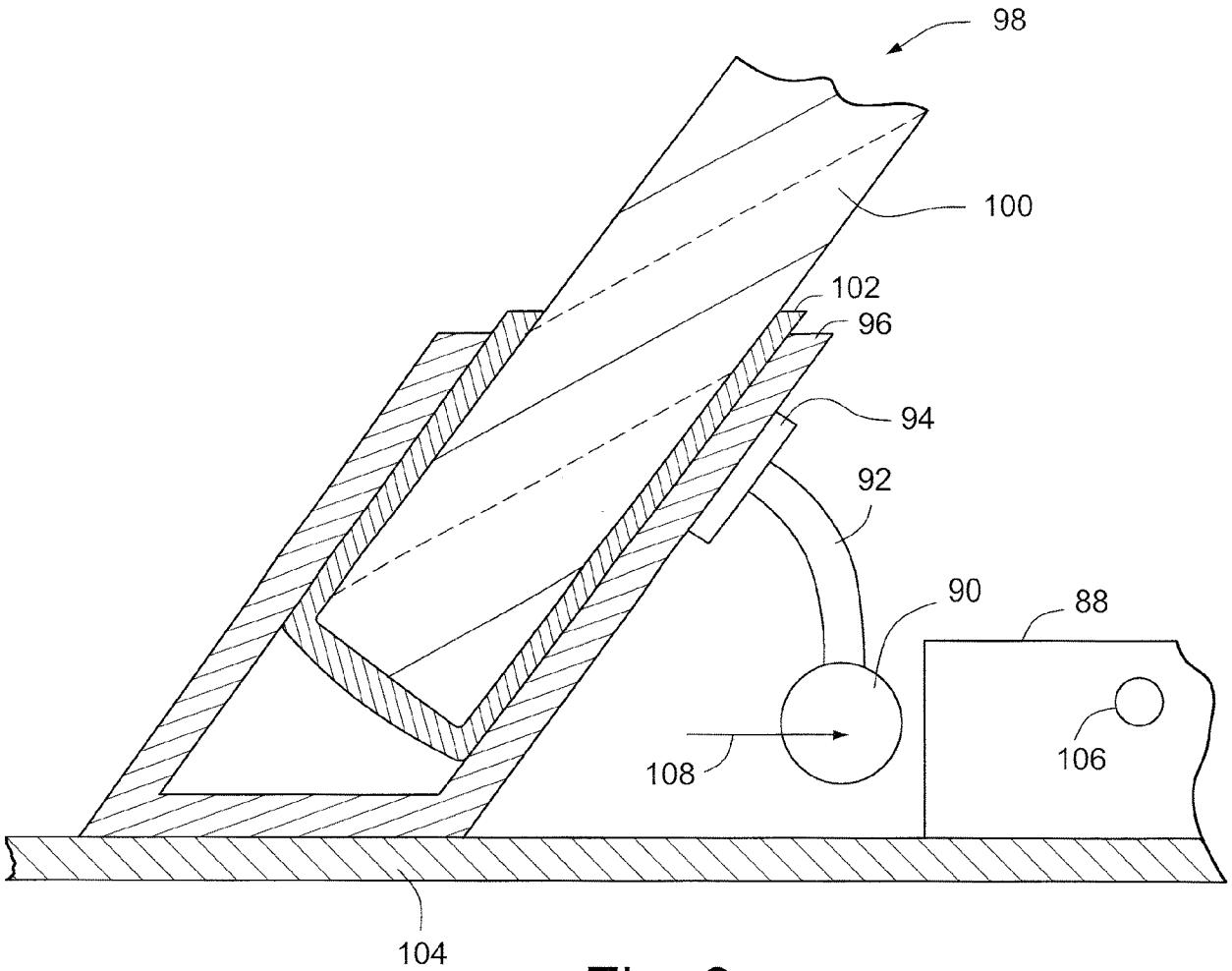
FIG. 9 is a cross-sectional side view of a bottom edge of the port side windshield segment illustrated in one of the preceding figures, showing one embodiment of a male portion of the securement device of the invention.

FIG. 9 illustrates a bracket 88 into which a male portion 90 is inserted. As should be apparent, the operation of the bracket 88 is essentially the same as that of the bracket 76. As shown in FIG. 9, the male portion 90 is disposed at the end of a rigid member 92. The rigid member 92 is attached to a plate 94 that connects to the bottom rail 96 of a windshield segment 98. The windshield segment 98 includes a transparent pane 100 and a gasket 102 to help secure the transparent pane 100 in the bottom rail 96. The bottom rail 96 sits atop a deck surface 104. Once the male portion 90 has been inserted into the female socket of the bracket 88, a pin (not illustrated) may be inserted into the opening 106 to retain the male portion 90 in the bracket 88. For reference, the arrow 108 indicates the direction in which the male portion 90 is inserted into the bracket 88.

Figure 10:
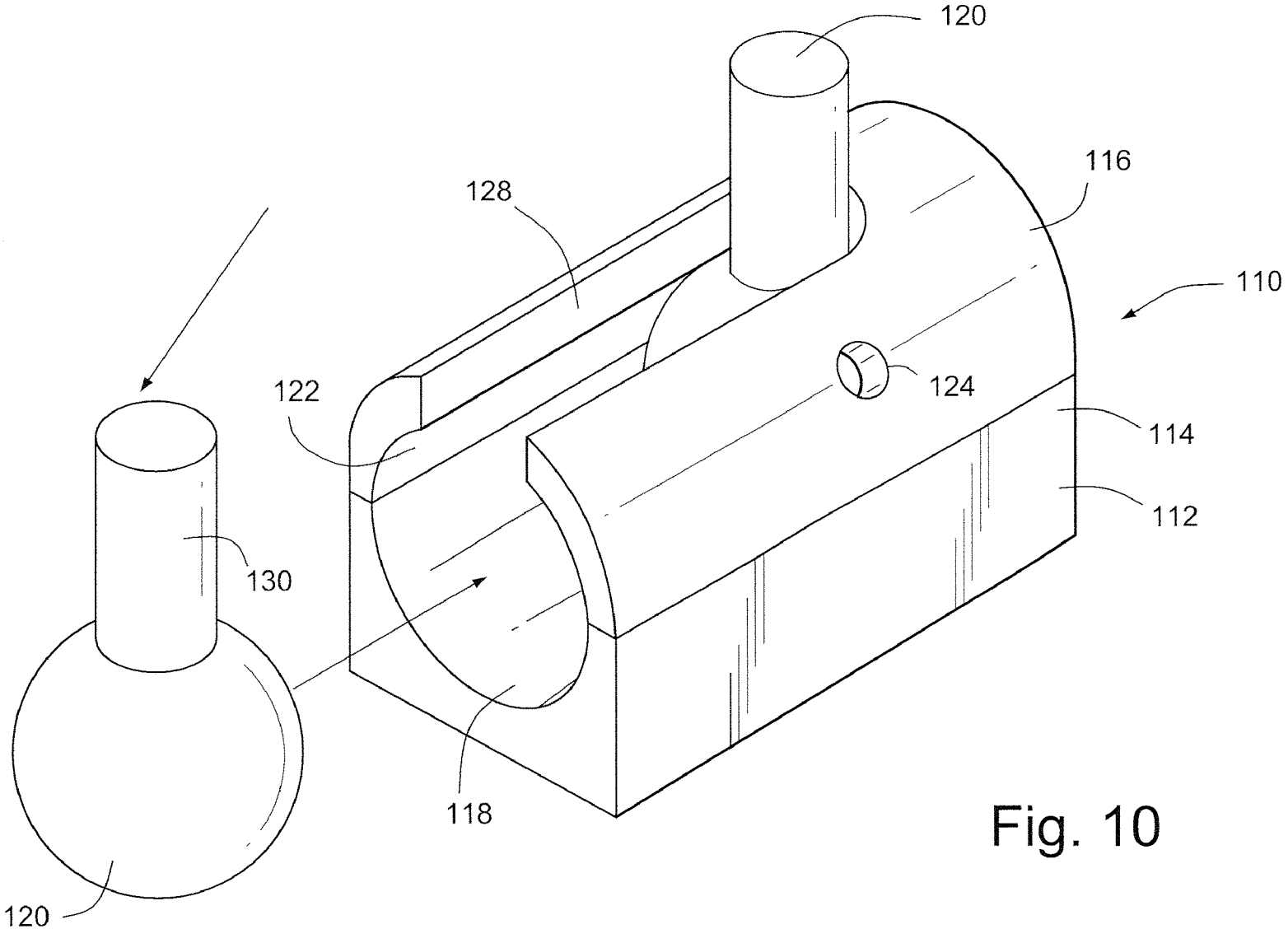
FIG. 10 is a perspective illustration of the interaction between a male portion and a first embodiment of a female portion of a securement device constructed according to the invention.

FIG. 10 illustrates one embodiment of a bracket 110. The bracket 110 includes a housing 112 with a lower body portion 114 and an upper body portion 116. The lower body portion 114 and the upper body portion 116 are connected to one another to create an opening 118, otherwise referred to as a receiving opening 118. The male portion 120 is inserted into the receiving opening 118. The receiving opening 118 is essentially a channel that is formed by the housing 112. It is contemplated that the channel walls 122 will have a diameter slightly greater than the diameter of the male portion 120. As noted in FIG. 10, and as illustrated in prior embodiments, the male portion 120 is spherical. As should be appreciated by those skilled in the art, the male portion 120 make take any shape. As also illustrated in FIG. 10, the bracket 110 includes an opening 124 into which a pin may be inserted to retain the male portion 120 therein. A slot 128 is also illustrated to accommodate the rigid member 130 connected to the male portion 120.

With respect to the opening 124, it is noted that there is a complimentary opening on the opposite side of the housing 112 so that the pin may be inserted completely through the housing 112. As should be appreciated by those skilled in the art, the pin need not extend all the way through the housing 112 to practice the invention.

Figure 11:
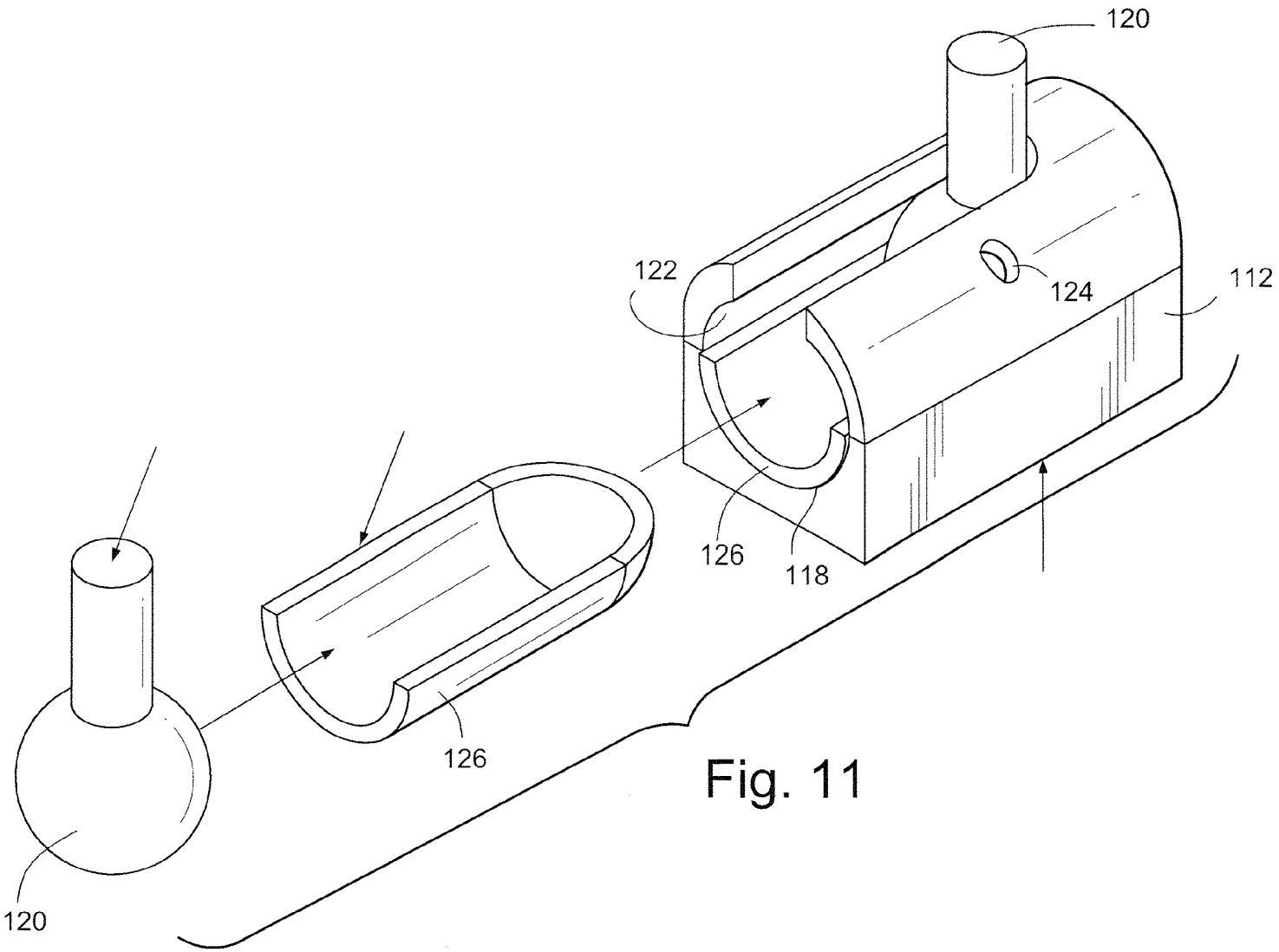
FIG. 11 is a perspective illustration of the interaction between a male portion and a second embodiment of a female portion of a securement device constructed according to the invention.

FIG. 11 illustrates a variation of the bracket 110. In this figure, the bracket 110 additionally includes an insert 126 that slides into the receiving opening 118. The insert 126 facilitates insertion and removal of the male portion 120 into and out of the female portion 118. It is expected that the insert 126 will be made from a plastic material, for example. Of course, other materials may be employed including ceramics, rubbers, composite materials, etc. It is noted that the housing 112 is expected to be made from a metal material. Common metals include aluminum, steel, and alloys thereof.

Figure 12:
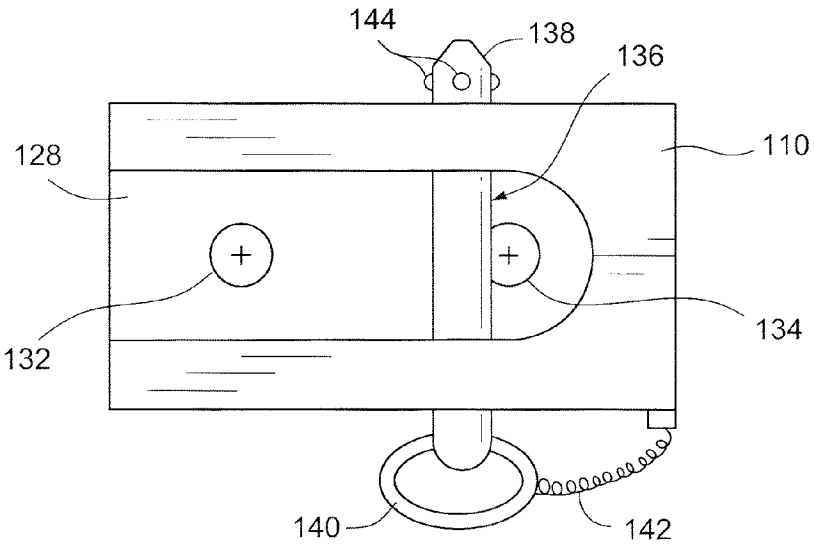
FIG. 12 is a top plan view of the second embodiment of the female portion of the securement device illustrated in FIG. 11.

FIG. 12 provides a top view of the bracket 110. In this illustration, the slot 128 is clearly visible, as are two openings 132, 134 at the bottom of the channel 118. The openings 132, 134 are provided so that screws, or other types of fasteners, may be inserted therein to secure the bracket 110 to the deck of a boat.

FIG. 12 also shows a pin 136 that is inserted through the opening 124 to retain the male portion 120 in the channel 118. The pin 136 includes a shaft 138 with a ring 140 at one end to permit a user to grasp the pin 136. The pin 136 may be secured to the bracket 110 via a tether 142, which may be elastic or inelastic. At the end of the pin 136, opposite to the ring 140, the shaft 138 includes one or more bearings 144 that are biased in an outwardly-protruding fashion so that the pin 136 is readily secured in the bracket 110.

Figure 13:
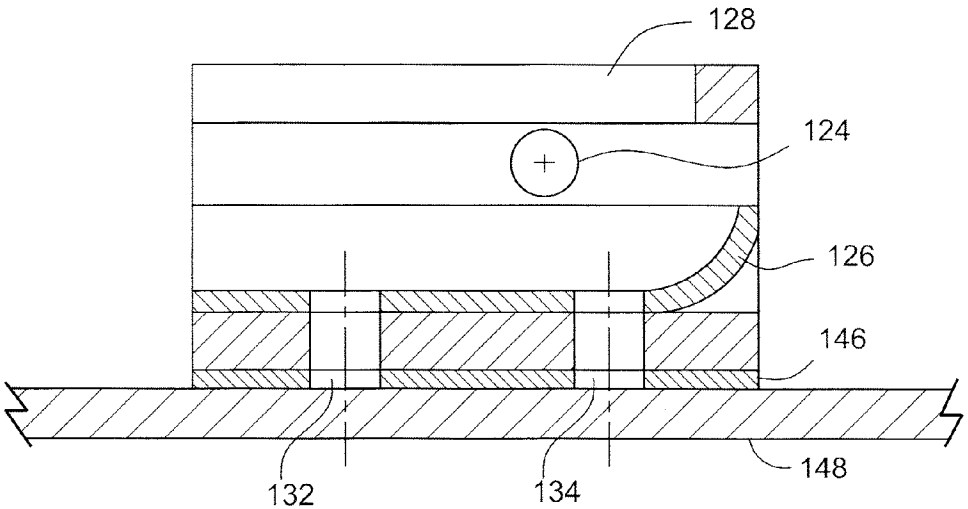
FIG. 13 is a cross-sectional side view of the female portion of the second embodiment of the securement device illustrated in FIG. 11.

FIG. 13 is a cross-sectional side view of the bracket 110. In this view, the insert 126 is visible. In addition, this view shows that the bracket 100 may include an adhesive strip 146 between the bottom of the housing 112 and the surface of the deck 148. As noted above, the adhesive strip facilitates placement of the bracket 110 on the deck 148 before fasteners, such as screws, are drilled through the deck 148 to more permanently secure the bracket 110 to the deck 148.

Figure 14:
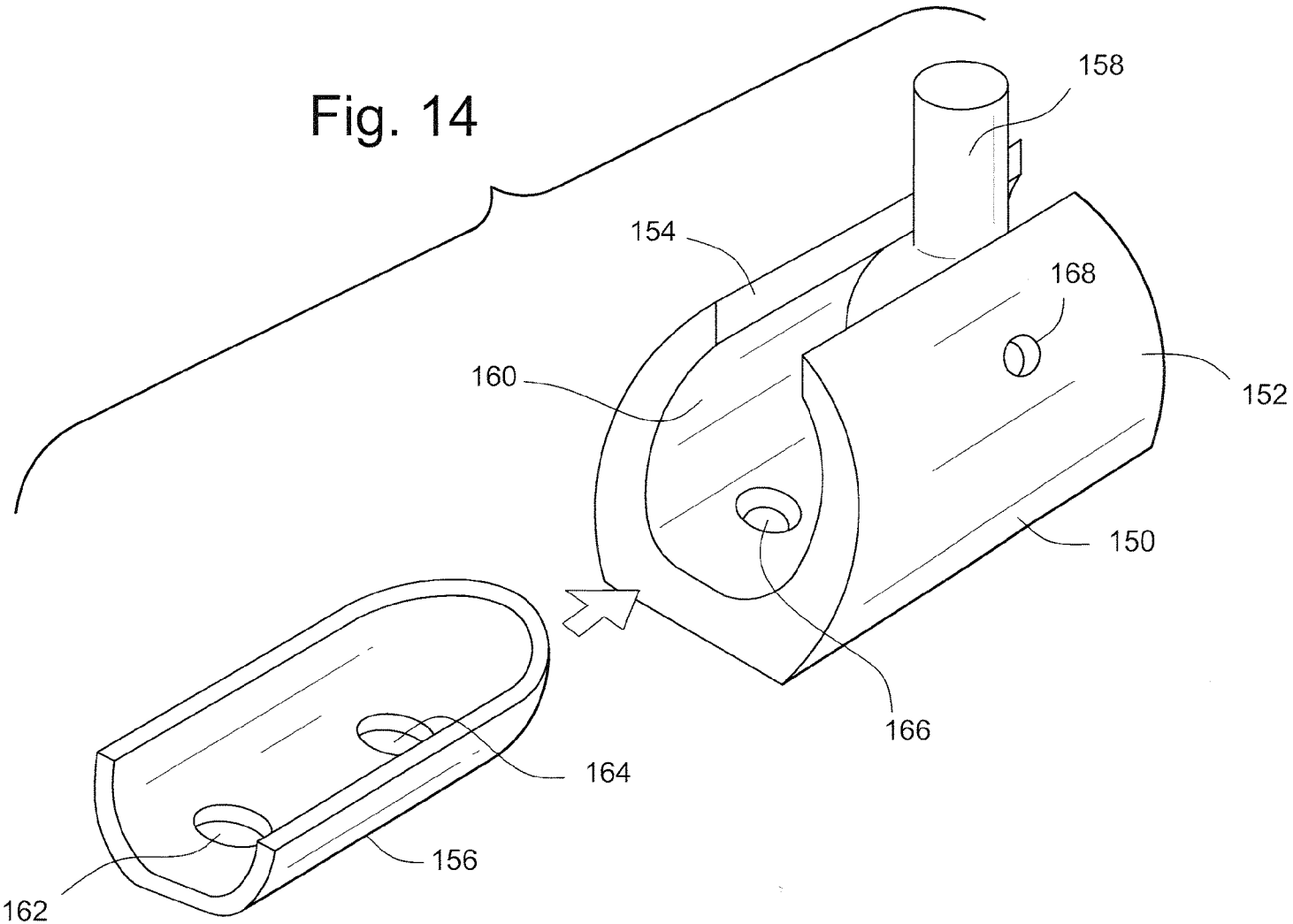
FIG. 14 is a perspective illustration showing the interaction between a male portion and a third embodiment of a female portion of a securement device constructed according to the invention.

FIG. 14 illustrates still another embodiment of a bracket 150. Here, the bracket 150 differs in the shape of the housing 152. In addition, the slot 154 extends from one side to the other. In this embodiment, the insert 156 helps to retain the male portion 158 in the channel 160. It is noted that the curved end of the insert 156 is the structure that helps hold the male portion 158 in the channel 160. Other shapes for this structure may be employed without departing from the scope of the invention. For example, the curved end may be replaced with a protrusion or other similar feature.

Openings 162, 164, 166 are also illustrated. The openings 162, 164, 166 permit fasteners to pass therethrough. An opening 168 is provided for a pin 136, as in the prior embodiment.

Figure 15:
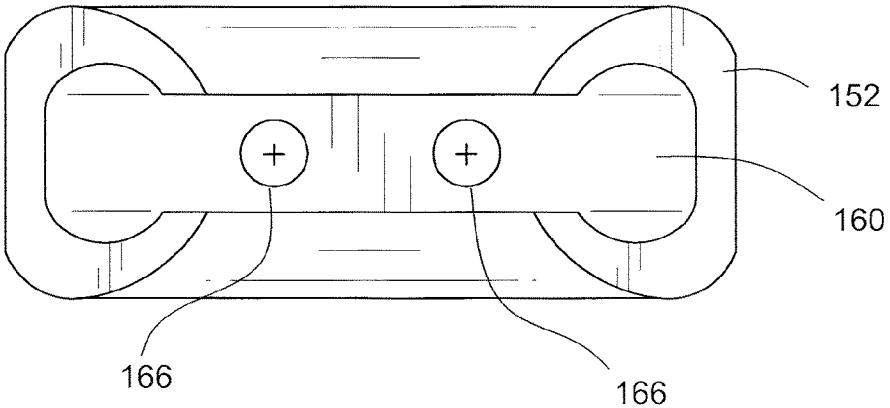
FIG. 15 is a top plan view of the female portion of the securement device illustrated in FIG. 14.
Figure 16:
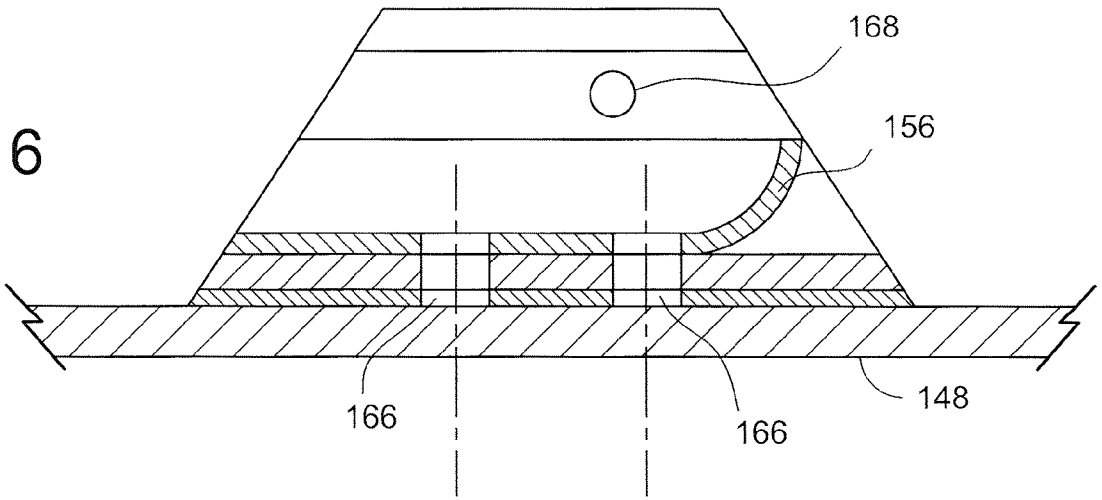
FIG. 16 is a cross-sectional side view illustration of the female portion of the securement device illustrated in FIG. 14.

FIG. 15 is a top view of the bracket 152, showing the openings 166 that permit the bracket 152 to be fastened to the deck 148 of a boat. FIG. 16 is a cross-sectional side view of the bracket 152.

The embodiments discussed herein are meant to be illustrative of the broad scope of the invention. They are not meant to be limiting of the invention solely to the embodiments described or illustrated. To the contrary, as should be appreciated by those skilled in the art, there are variations and equivalents of the invention that may be employed. The invention is intended to encompass those variations and embodiments.

What is claimed is:

1. A removable boat windshield, comprising:

a transparent pane with a top end and a bottom end;

at least one male portion attached to the pane;

at least one female portion attachable to a deck of a boat, wherein the female portion defines a receiving opening for receiving the at least one male portion therein;

a securement device, operable with the at least one female portion, to releasably secure the male portion in the female portion, wherein the female portion comprises a housing that defines the receiving opening, the receiving opening is disposed longitudinally in the housing, and at least one opening for receiving the securement device extends through the housing transversely to the receiving opening, and wherein the housing comprises side walls that enclose the male portion, the side walls and the securement device being structured and oriented to prevent the male portion from being lifted from the housing, and the securement device being structured and oriented to prevent the male portion from being translated from the housing in a direction along the receiving opening.

2. The removable boat windshield of claim 1, wherein the securement device comprises a removable pin.

3. The removable boat windshield of claim 1, wherein the at least one male portion comprises: a plate securable to the pane; and a protrusion attached to the plate, extending a predetermined distance from the pane; wherein at least a portion of the protrusion is received in the receiving opening of the at least one female portion.

4. The removable windshield of claim 3, wherein the at least one male portion further comprises: a shaped end disposed at an end of the protrusion opposite to the plate.

5. The removable windshield of claim 4, wherein the shaped end is spherical.

6. The removable windshield of claim 3, wherein the plate is securable to the pane via threaded fasteners.

7. The removable windshield of claim 3, wherein the plate and the protrusion are integrally formed.

8. The removable windshield of claim 5, wherein the plate, the protrusion, and the shaped end are integrally formed.

9. The removable windshield of claim 1, wherein the at least one female portion is attachable to the deck of the boat via an adhesive strip and threaded fasteners.

10. The removable windshield of claim 1, wherein the at least one male portion is attached to a bottom rail on a bottom end of the pane.

11. A method of installing a removable windshield onto a deck of a boat, comprising:

positioning a plurality of female portions on the deck of a boat, the female portions each comprising a housing defining a receiving opening extending longitudinally therethrough and also defining at least one opening transversely therethrough;

attaching a corresponding plurality of male portions to a transparent pane of the removable windshield;

inserting a first of the male portions into the receiving opening in a first of the female portions by laterally displacing the removable windshield, wherein the female portion also comprises at least one opening transverse to the receiving opening;

inserting a second of the male portions in a second of the female portions by rotating the removable windshield; and inserting a securement device into the transverse openings of each of the female portions after inserting the male portions into the respective receiving openings.

12. The method of claim 11, wherein the at least one female portion is positioned initially on the deck of the boat via an adhesive.

13. The method of claim 11, further comprising:

securing the female portion to the deck of the boat with at least one fastener.

14. The removable windshield of claim 1, wherein the at least one male portion is attached to a bottom of a stanchion.

15. The removable windshield of claim 1, wherein the at least one male portion is attached to the pane by fasteners through holes in the pane.

* * * * *